US005435704A

United States Patent [19]

Sawyer

[11] Patent Number: 5,435,704

[45] Date of Patent: Jul. 25, 1995

[54] CAPACITY AND VOLUME RATIO CONTROL VALVE ASSEMBLY

[75] Inventor: John A. Sawyer, Trout Run, Pa.

[73] Assignee: Dresser-Rand Company, Corning, N.Y.

[21] Appl. No.: 316,991

[22] Filed: Oct. 3, 1994

[51] Int. Cl.[6] ..... F01C 1/16

[52] U.S. Cl. ..... 418/201.2; 417/440; 251/205

[58] Field of Search ..... 418/201.2, 159; 417/310, 440; 137/625.3; 251/205, 329

[56] References Cited

U.S. PATENT DOCUMENTS

| | | | |
|---|---|---|---|
| 4,579,513 | 4/1986 | Zimmern et al. | 418/201.2 |
| 4,610,612 | 9/1986 | Kocher | 418/201.2 |
| 4,610,613 | 9/1986 | Szymaszek | 418/201.2 |

*Primary Examiner*—Richard A. Bertsch
*Assistant Examiner*—Charles G. Freay
*Attorney, Agent, or Firm*—Bernard J. Murphy

[57] ABSTRACT

Volume ratio and capacity are controlled by slides which are rail guided. The slides are pressure-balanced, axillay and radially. The volume ratio slide has a piston balancing arrangement. The capacity slide has suction pressure acting equally on all sides thereof, consequently it requires no piston balancing.

8 Claims, 5 Drawing Sheets

CAPACITY AND VOLUME RATIO CONTROL VALVE ASSEMBLY

This invention pertains to control valve assemblies such as are used with screw-type gas compressors, and in particular to a capacity and volume ratio control valve assembly, of the dual-slide type, for use with single screw or twin screw gas compressors. Such are known in the prior art, and the U.S. Pat. No. 4,704,069, issued on Nov. 3, 1987, to Erich J. Kocher, for a "Method for Operating Dual Slide Valve Rotary Gas Compressor" is exemplary thereof as well as is U.S. Pat. No. 4,610,613, issued to Paul G. Szymaszek, on Sep. 9, 1986, for "Control Means for Gas Compressor Having Dual Slide Valves".

Commonly, the single screw gas compressor volume ratio and capacity is regulated by the use of control slides that translate parallel with the axis of the main screw. Such regulation is either of the single slide design, controlling the capacity without an ability for optimizing the volume ratio, or of a dual slide design with a volume ratio slide and a capacity slide, the two independent of each other, and offering increased compressor control. The volume ratio slide enlarges and repositions the discharge port location, thereby increasing or decreasing the volume ratio of the gas compressor. The capacity control slide changes the location from whence the compression cycle is started, whereby the capacity of the gas compressor is affected. Typically, two control slide assemblies are used in each gas compressor, i.e., either two single or two dual slide assemblies, the same requiring balance pistons on each slide to counter the axial forces created by the gas pressure on the ends of the slides. Known slide designs have a large surface area on the back side of both the volume and capacity slides. Discharge pressure acting on these areas creates an unbalanced radial force inwardly toward the screw. This inwardly-directed force deflects the rails and presents the possibility of contact with the outside diameter of the screw, as well as scoring or seizing of the machine. The radial force causes the surface between the rail and the slide to wear, allowing the slide to be pushed inwardly toward the screw, decreasing the normal operating clearance around the screw, and eventually contacting the screw and seizing the gas compressor.

It is an object of this invention to set forth a capacity and volume ratio control valve assembly in which the aforesaid radial force is effectively counterbalanced. Too, it is an object of this invention to disclose a capacity and volume ratio control valve assembly in which only the volume ratio slide needs to be piston-balanced.

Particularly, it is an object of this invention to set forth, for use with a screw compressor having a compression chamber, a capacity and volume ratio control valve assembly comprising a valve assembly housing; said housing having an arcuate wall and an opening for communication with the compression chamber of a screw compressor; an elongated volume ratio slide, slidably confined within said housing; a back-up slide support, confined within said housing, and slidably engaged with said wall; a spacer interposed between said slide and said support for defining a clear space between said support and slide; and a rail, joined to said wall, and extending therefrom, intervening between said slide and said support for guiding said support and said slide in movement lengthwise of said housing; and wherein said support, said slide and said spacer are fastened together.

It is a further object of this invention to disclose a valve assembly according to the aforesaid in which said clear space is open to communication with said compression chamber and such discharge pressure therein; said volume ratio slide has a surface exposed to said clear space and which reacts to pressure therein to urge said volume ratio slide in a given direction; and said support has a surface exposed to said clear space and which reacts to pressure therein to urge said support in a direction opposite to said given direction, whereby such discharge pressure is counterbalanced.

Further objects of this invention, as well as the novel features thereof, will become apparent by reference to the following description taken in conjunction with the accompanying figures, in which.

Figure 1:
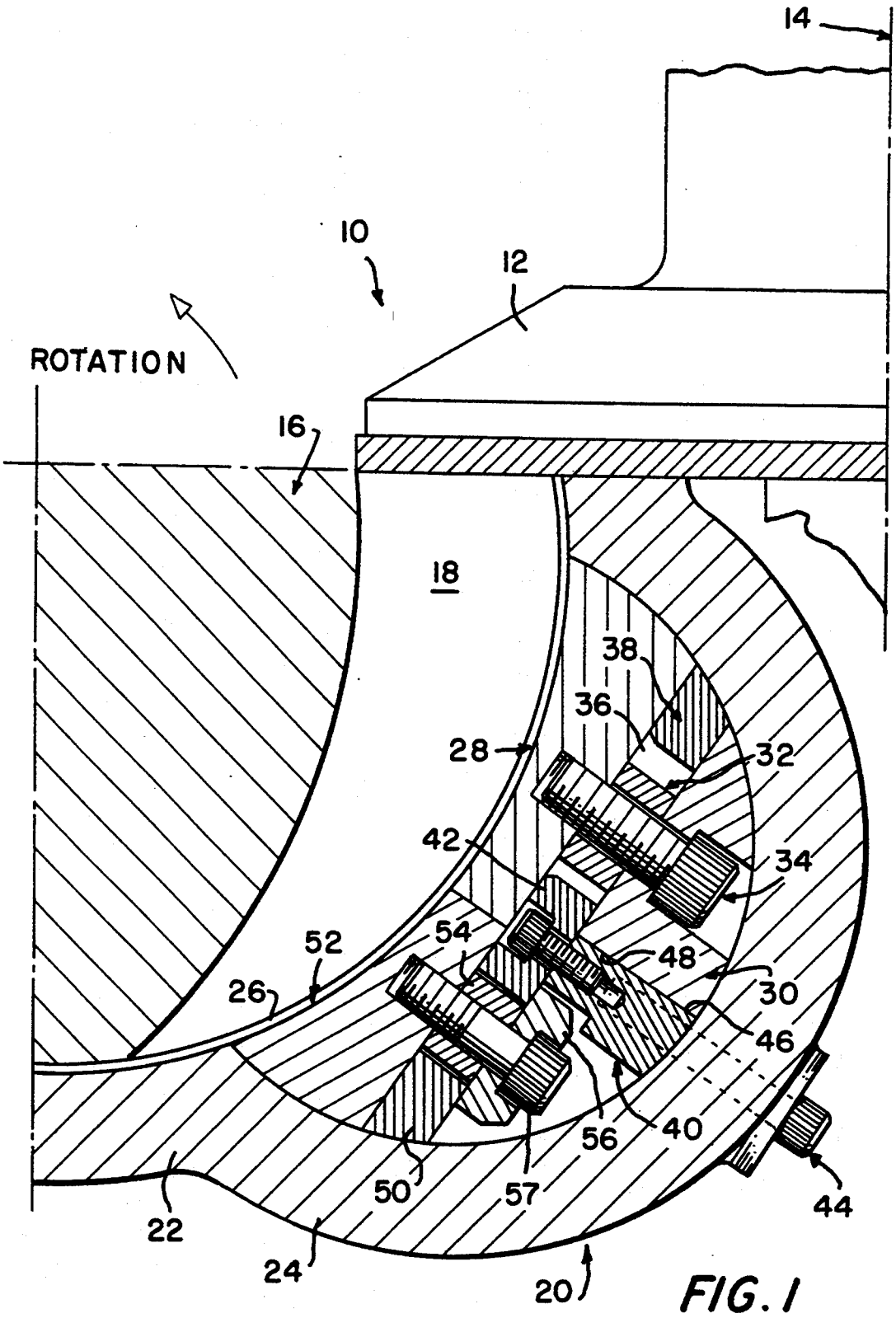
FIG. 1 is a cross-sectional view of an embodiment of the invention, the same having been taken along section 1—1 of FIG. 2.

As shown in FIGS. 1 through 4, a single screw gas compressor 10 has a gate rotor 12 with a centerline 14 and a coating screw 16, and a compression chamber 18. The novel valve assembly 20 comprises a housing 22 having an arcuate wall 24 and an opening 26. The opening 26 is in communication with the chamber 18. An elongate volume ratio slide 28 is slidably confined within the housing 22. Too, a back-up slide support 30 is slidably confined within the housing 22 and engaged with the wall 24. A spacer 32 is interposed between the slide 28 and the support 30; the spacer 32 is fastened, by bolt 34, to the support 30 and the slide 28, and cooperates to define a clear space 36 between the slide 28 and the support 30. A rail 38, joined to the wall 24, and extending therefrom, intrudes between the support 30 and the slide 28 for guiding the support and slide in movement,lengthwise of the housing 22.

A separating partition 40, having a transverse rib 42 fastened thereto, is secured to the wall 24 by a mounting bolt 44. The rib 42 cooperates with the rail 38 in guiding the slide 28 and support 30 in axial translation. The partition 40 has a flat surface 46 which confrontingly engages a corresponding flat surface 48 of the support 30. The rib 42 also cooperates with a second rail 50 in slidably guiding an elongated capacity slide 52 which is also confined within the housing 22. Another spacer 54 intervenes between the slide 52 and a second support 56, the latter being slidably engaged with the rib 42 and rail 50 for guiding the slide 52 in axial translation. Bolt 57 fastens the support 56 and the spacer 54 to the slide 52.

Figure 2:
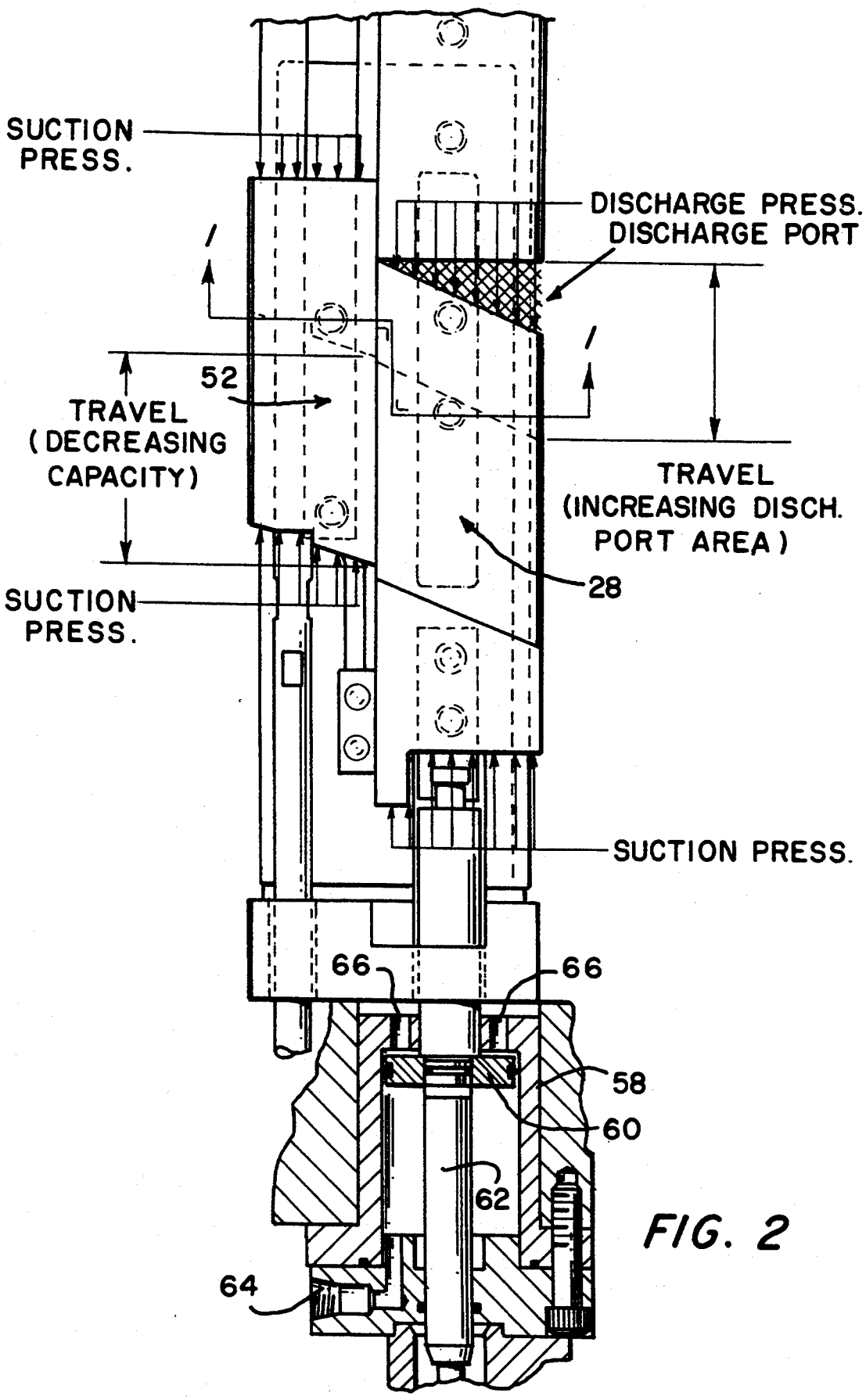
FIG. 2 is an elevational view of the invention, partly cross-sectioned, as seen from the compression chamber of the compressor of FIG. 1.

FIG. 2, especially, shows the piston pressure balancing arrangement for the volume ration slide 28. The arrangement comprises a cylinder 58 coupled to the housing 22 and having a centrally-bred piston 60 movably disposed therein. An adjusting rod 62 is coupled to and in penetration of the piston 60, and has an upper end thereof coupled to the slide 28. Porting 64 admits pressured fluid to the underside of the piston 60, to cause its elevation in the cylinder 58 and the resulting upward translation of the slide 28, and ports 66 permit fluid and gas to vent from the cylinder 58. The piston 60 and cylinder 58 arrangement is provided to counter the differential pressure acting axially on the upper end of the slide 28.

The separating partition 40 prevents the discharge pressure from contacting the back of the capacity slide 52, creating a pressure-balanced capacity slide thereof, balanced both axially and radially, with suction pressure acting equally on all sides of the slide 52. This eliminates the need,for piston balancing of slide 52, and eliminates most of the weak between the slide 52, the rail 50, and transverse rib 42. As a consequence, it requires a minimal force to move the slide 52, axially.

Figure 3:
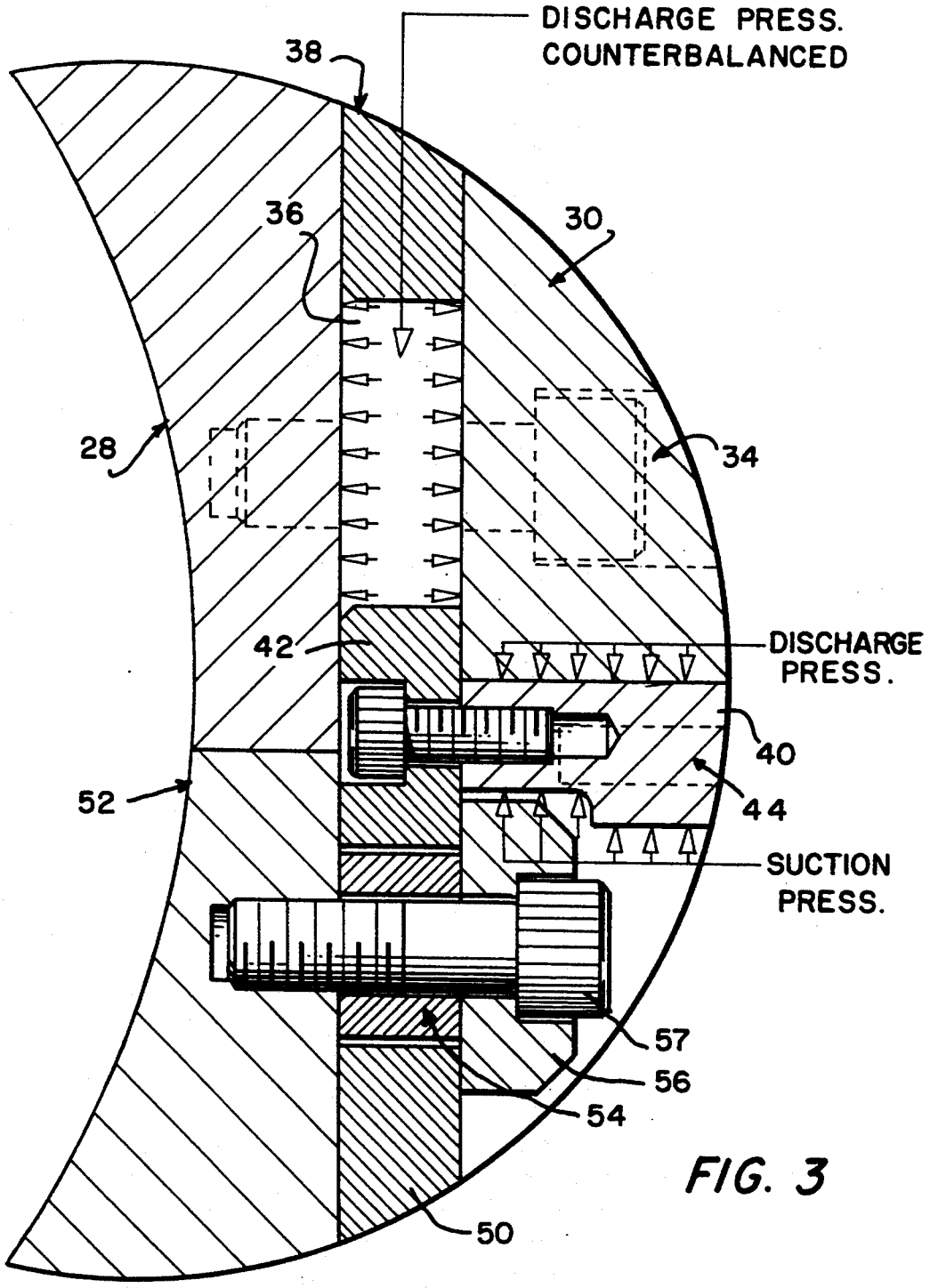
FIG. 3 is an enlarged, cross-sectional view of the invention corresponding, generally to that of FIG. 1, albeit rotated relative thereto, showing the pressure balancing within the clear space and across the separating partition.
Figure 4:
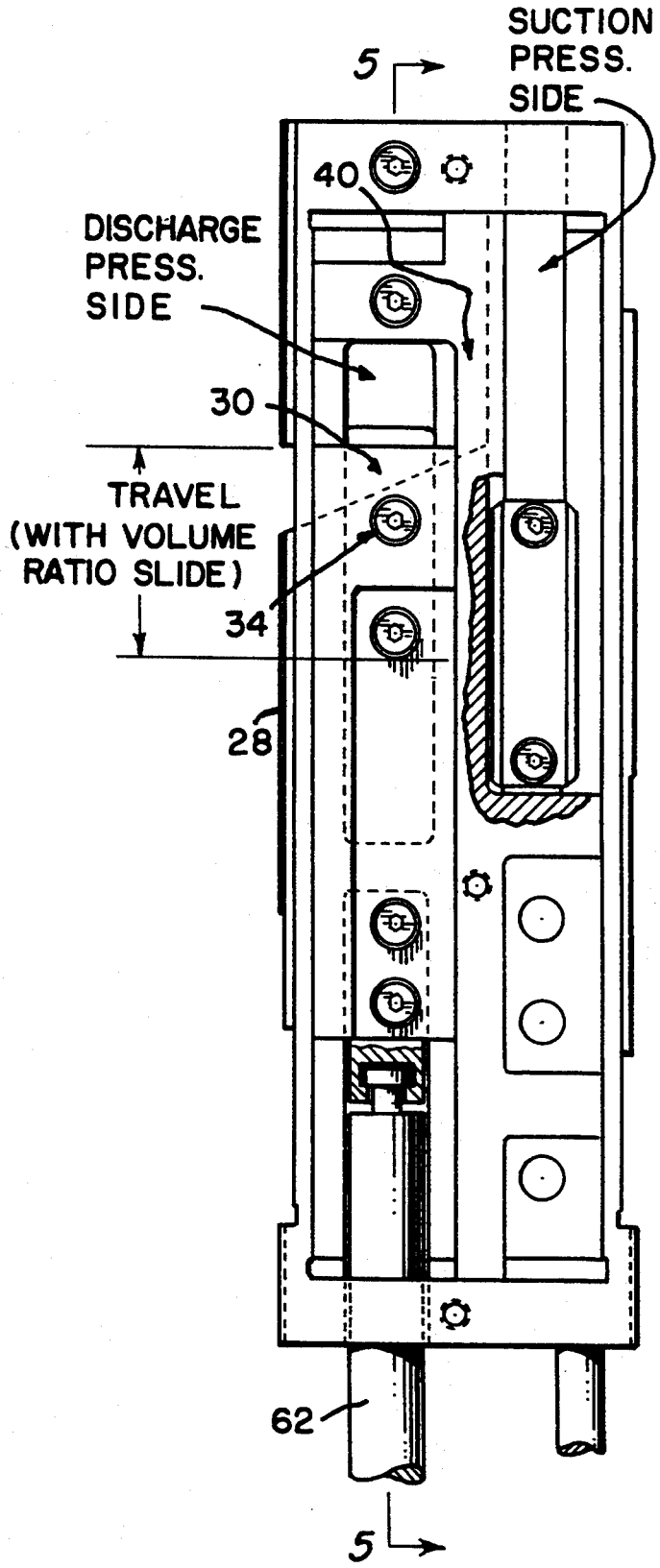
FIG. 4 is an elevational view of the invention, the same being a depiction of the reverse side of FIG. 2.

The separating partition 40 prevents the discharge pressure from coming into communication with the suction pressure, as shown in FIG. 3. Too, the clear space 36 cooperates to balance the slide 28. The confronting surfaces of the slide 28 and the support 30, which are spaced across the space 36, have the discharge pressure bearing thereupon. The slide 28 is urged by the pressure in the direction of the chamber 18, and the pressure urges the support 30 in the opposite direction. As the two are bolted together, by bolt 34, through spacer 32, the pressure is counterbalanced.

Figure 5:
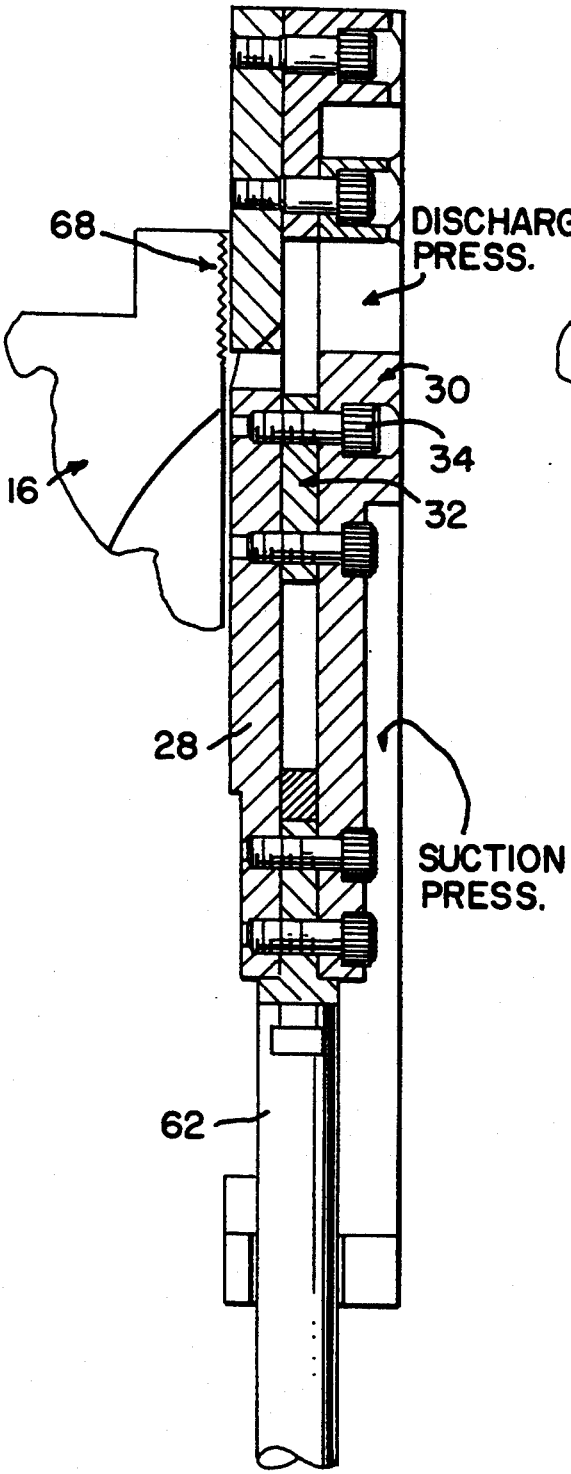
FIGS. 5 and 6 are vertical, cross-sectional views of the invention, taken along section 5—5 of FIG. 4, the same depicting differing labyrinth sealing of the screw.
Figure 6:
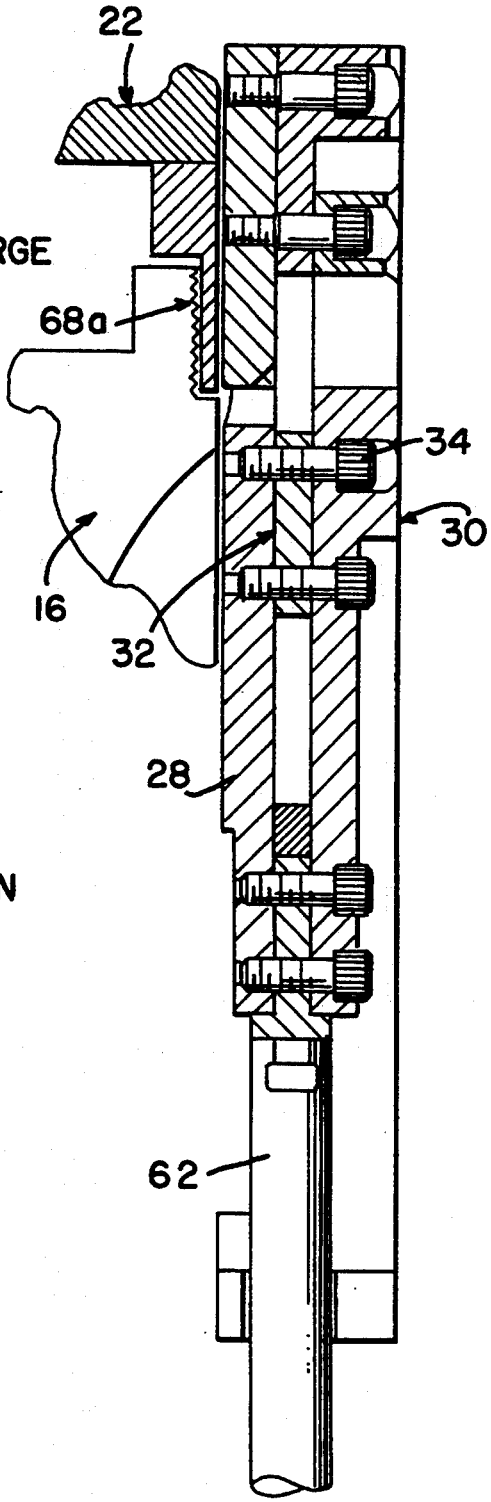

Due to the design of treated partition 40, the high pressure labyrinth seal 68 can be on the outside diameter of the screw 16, as shown in FIG. 5, or can be of a stepped design **68*a*, as shown in FIG. 6**.

My novel valve assembly 20 is capable of higher differential pressure between the suction and discharge pressures. The volume ratio, and capacity slides 28 and 52, respectively, are radially pressure balanced, preventing distortion into the o. d. of the screw 16 and seizing of the compressor 10. More, the capacity slide 52 is internally pressure-balanced, axially, and does not need a balance piston. For being radially balanced, the slides 28 and 52 experience less friction and resulting wear between the rails 38 and 50, consequently it requires less force to position the slides. Too, the invention offers the flexibility of either a stepped, high pressure labyrinth seal **68*a* or a labyrinth seal 68 on the o. d. of the screw 16**.

While I have described my invention in connection with a specific embodiment thereof, it is to be clearly understood that this is done only by way of example, and not as a limitation to the scope of my invention, as set forth in the objects thereof and in the appended claims.

I claim:

1. For use with a screw compressor having a compression chamber, a capacity and volume ratio control valve assembly, comprising:

a valve assembly housing;

said housing having an arcuate wall and an opening for communication with the compression chamber of a screw compressor;

an elongated volume ratio slide, slidably confined within said housing;

a back-up slide support, confined within said housing, and slidably engaged with said wall;

a spacer interposed between said slide and said support for defining a clear space between said support and said slide; and a rail, joined to said housing wall, and extending therefrom, intervening between said slide and said support for guiding said support and said slide in movement lengthwise of said housing; and wherein said support, said slide and said spacer are fastened together.

2. A valve assembly, according to claim 1, wherein:

said rail intrudes into said clear space between said support and said slide.

3. A valve assembly, according to claim 1, wherein:

said support has a flat surface which extends substantially perpendicular to said wall; and further including a separating partition fastened to said wall; and wherein said partition has an extended flat surface which confrontingly engages said flat surface of said support.

4. A valve assembly, according to claim 3, wherein:

said partition has a rib fastened thereto; and further including an elongated, capacity slide, slidably confined within said housing;

a second rail, joined to said housing wall, and extending therefrom; and said capacity slide slidably engages said second rail, said rib, and said volume ratio slide.

5. A valve assembly, according to claim 4, wherein:

a spacer, juxtaposed with said rib, is fastened to said capacity slide.

6. A valve assembly, according to claim 1, further including:

means defining a cylinder coupled to said housing;

a centrally bred piston movably disposed within said cylinder;

a rod coupled to, and in penetration of said piston; and wherein an end of said rod is joined to said volume ratio slide.

7. A valve assembly, according to claim 6, wherein:

said cylinder has porting means formed in one end thereof for admitting pressured fluid thereinto, and has venting means formed in the opposite end thereof for exhausting fluid therefrom.

8. A valve assembly, according to claim 1, wherein:

said clear space is open to communication with said compression chamber and such discharge pressure therein;

said volume ratio slide has a surface exposed to said clear space and which reacts to pressure therein to urge said volume ratio slide in a given direction;

said support has a surface exposed to said clear space and which reacts to pressure therein to urge said support in a direction opposite to said given direction, whereby such discharge pressure is counterbalanced.

* * * * *

UNITED STATES PATENT AND TRADEMARK OFFICE

CERTIFICATE OF CORRECTION

PATENT NO. : 5,435,704

DATED : July 25, 1995

INVENTOR(S) : John A. Sawyer

It is certified that error appears in the above—identified patent and that said Letters Patent is hereby corrected as shown below:

ON THE TITLE PAGE:

In the Abstract, line 3, "axillay" should read: - - axially - - ;

In column 2, line 35, "coating" should read: - - coacting - - ;

In column 2, line 50, delete the "," (comma);

In column 2, line 65, change "ration" to - - ratio - - ;

In column 2, line 67, change "bred" to - - bored - - ;

In column 3, line 15, delete the "," (comma) following "need" - - ;

In column 3, line 16, change "weak" to - - wear - - ;

In column 3, line 30, change "treated" to - - the aforesaid - - ; and

In claim 6, line 4, change "bred" to - - bored - - .

Signed and Sealed this

Tenth Day of October, 1995

Bruce Lehman

*Attest:*

BRUCE LEHMAN

*Attesting Officer*

*Commissioner of Patents and Trademarks*